US007162419B2

(12) United States Patent
Ojanperä

(10) Patent No.: US 7,162,419 B2
(45) Date of Patent: Jan. 9, 2007

(54) METHOD IN THE DECOMPRESSION OF AN AUDIO SIGNAL

(75) Inventor: Juha Ojanperä, Tampere (FI)

(73) Assignee: Nokia Corporation, Espoo (FI)

( * ) Notice: Subject to any disclaimer, the term of this patent is extended or adjusted under 35 U.S.C. 154(b) by 897 days.

(21) Appl. No.: 10/137,776

(22) Filed: May 1, 2002

(65) Prior Publication Data

US 2002/0165710 A1 Nov. 7, 2002

(30) Foreign Application Priority Data

May 4, 2001 (FI) ..... 20010940

(51) Int. Cl.
*G10L 19/04* (2006.01)
*G10L 19/14* (2006.01)

(52) U.S. Cl. ..... 704/219; 704/500; 704/501

(58) Field of Classification Search ..... 704/201, 704/219, 500, 501, 503, 504
See application file for complete search history.

(56) References Cited

U.S. PATENT DOCUMENTS

| | | | | |
|---|---|---|---|---|
| 3,947,638 | A * | 3/1976 | Blankinship | 704/207 |
| 4,500,985 | A * | 2/1985 | Chang | 370/244 |
| 4,811,376 | A * | 3/1989 | Davis et al. | 340/7.28 |
| 4,910,783 | A * | 3/1990 | Nakagawa | 704/241 |
| 5,327,520 | A | 7/1994 | Chen | |
| 5,794,181 | A * | 8/1998 | Benbassat et al. | 704/212 |
| 5,884,010 | A * | 3/1999 | Chen et al. | 704/228 |
| 6,009,395 | A | 12/1999 | Lai et al. | 704/264 |
| 6,691,082 | B1 * | 2/2004 | Aguilar et al. | 704/219 |
| 6,757,659 | B1 * | 6/2004 | Tanaka et al. | 704/501 |
| 6,862,630 | B1 * | 3/2005 | Garg et al. | 709/250 |

FOREIGN PATENT DOCUMENTS

| | | |
|---|---|---|
| EP | 0 847 155 A | 6/1998 |
| WO | 01/03122 | 1/2001 |

OTHER PUBLICATIONS

"A Novel MPEG-2 Audio Decoder with Efficient Data Arrangement and Memory Configuration," IEEE Transactions on Consumer Electronics, IEEE Inc. New York, vol. 43, No. 3, Aug. 1, 1997, pp. 598-604.

* cited by examiner

*Primary Examiner*—Martin Lerner
(74) *Attorney, Agent, or Firm*—Alfred A. Fressola; Ware, Fressola, Van Der Sluys & Adolphson LLP

(57) ABSTRACT

The invention relates to a method in the decompression of a compressed audio signal. In the decompression, a predicting coding has been used, wherein samples taken of the audio signal have been formed into frames, and the samples of the frames have been compared with past samples to find out the prediction error. In the method, frames ($fr_n$, $fr_{n-1}$, $fr_{n-2}$) of the compressed audio signal are stored, and a predicting decoding is used to decompress the audio signal compressed with the predicting coding, on the basis of said stored frames ($fr_n$, $fr_{n-1}$, $fr_{n-2}$). In the method, at least one memory pointer is used to indicate the storage location of the frames ($fr_n$, $fr_{n-1}$, $fr_{n-2}$). Said memory pointers (P1, P2) are used to point to the storage location of the frame ($fr_{n-1}$) preceding the frame ($fr_n$) being processed at the time, and to the storage location of the frame ($fr_{n-2}$) preceding said past frame ($fr_{n-1}$).

18 Claims, 5 Drawing Sheets

METHOD IN THE DECOMPRESSION OF AN AUDIO SIGNAL

BACKGROUND OF THE INVENTION

The present invention relates to a method in the decompression of a compressed audio signal, in which compression a predicting coding has been used, wherein samples taken from the audio signal have been formed into frames, and samples of the frames have been compared with samples of at least one previous frame to find out the prediction error, in which method frames of the compressed audio signal are stored, and predicting decoding is used to decompress the audio signal compressed with the coding on the basis of said stored frames. The invention also relates to a decompressing device for decompressing a compressed audio signal, in which compression a predicting coding has been used, wherein samples taken from the audio signal have been formed into frames, and samples of the frames have been compared with samples of at least one past frame to find out the prediction error, which decompressing device comprises memory means for forming at least one buffer for storing frames of the compressed audio signal, and means for performing the predicting decoding in the decompression of the audio signal compressed with the coding on the basis of said stored frames. The invention further relates to an electronic device comprising a decompressing device for decompressing a compressed audio signal, in which compression a predicting coding has been used, wherein samples taken from the audio signal have been formed into frames, and samples of the frames have been compared with samples of at least one past frame to find out the prediction error, which electronic device comprises memory means for forming at least one buffer for storing frames of the compressed audio signal, and means for performing the predicting decoding in the decompression of the audio signal compressed with the coding on the basis of said stored frames.

FIELD OF THE INVENTION

Various speech coding systems are used to form compressed signals from an analog audio signal, such as a speech signal, the compressed signals being transmitted to a receiver by communication methods used in a communication system. In the receiver, an audio signal is formed on the basis of these encoded signals. The quantity of the information to be transmitted is affected e.g. by the bandwidth available for this compressed information in the system, as well as by the efficiency at which the compression can be performed at the transmission stage.

PRIOR ART

For the compression, digital samples are formed of the analog signal at intervals of e.g. 0.125 ms. These samples are preferably processed in sets of a fixed length, such as sets of samples formed in about 20 ms, which are subjected to coding operations. These sets of samples taken at intervals are also called frames.

In speech compression systems, the aim is to provide as good a sound quality as possible within the scope of the available bandwidth. For this purpose, the periodic property of the audio signal, particularly speech signal, is utilized. The periodicity in speech is caused by e.g. the vibrations of the vocal cords. Typically, the period of this vibration is in the order of 2 to 20 ms. Several speech encoders of prior art apply so-called long-term prediction (LTP) to estimate this periodicity and to utilize it in compression. Thus, at the compression stage, the part (frame) of the audio signal to be compressed is compared with previously compressed audio signals. If an almost identical signal is found in stored samples, the time difference (lag) between the found signal and the signal to be compressed is determined. Also, an error signal is formed on the basis of the samples on the found signal and the signal to be compressed. Thus, compression is preferably performed in such a way that only the lag information and the error signal are transmitted. In the receiver, on the basis of this lag, the correct samples are retrieved from the memory and combined with the error signal.

Appended FIG. 1 shows, in a reduced block chart, a long term prediction (LTP) block used in a compression block 10 according to prior art. The signal to be compressed is converted to the frequency domain and conducted to a coding error computing block FSS. In the prediction block LTP, a time domain prediction signal is formed by using past sample sequences (frames) stored in a sample buffer (LTP buffer) as well as the signal to be compressed. The prediction signal is converted to the frequency domain in a time-to-frequency conversion block MDCT, forming a set of narrow-band signals. These narrow-band signals are conducted to the coding error computing block FSS to perform the frequency band specific computation of the coding error. Thus, the coding error computing block FSS determines for each frequency band, whether the coding error is sufficiently small to reduce the quantity of the information to be transmitted. In such a situation, information is transmitted regarding which frequency band uses the predicted signal, which previously transmitted sample sequence was used to form the prediction signal, information about the parameters used in the prediction (e.g. orders of the long-term prediction block), and the coding error in the respective frequency band. In other cases, the respective frequency band of the original signal is transmitted. The long-term prediction can be made with several different orders to form sets of reduction rates to correspond to the different orders, wherein the coding error can be determined for the different orders to find out the order which produces the smallest coding error.

An alternative implementation to convert the time-domain signal to the frequency domain is a filter bank consisting of several band-pass filters. The pass band of each filter is relatively narrow, wherein the signal strength values at the filter outputs indicate the frequency spectrum of the signal to be converted.

Moreover, the signal to be transmitted is quantized at a quantization block to further reduce the information to be transmitted.

In a compression block 10, the sample buffer is also updated according to the frequency band, preferably in the following way. The quantized samples of such frequency bands which have been formed on the basis of a prediction signal, are combined with the prediction signal, after which this combined signal is converted to the time domain in a frequency-to-time converter IMDCT and is stored in the sample buffer. In a corresponding manner, the quantized sample sequences of such frequency bands of the signal to be compressed, in which no prediction has been used, are converted to the time domain without being combined with the prediction signal. Also these sample sequences converted to the time domain are stored in the sample buffer, to be used for the prediction of later sample sequences of the signal to be compressed. It should also be mentioned that the situation may vary on different frequency bands as the compression proceeds, wherein it is possible to compress a part of the signal of a frequency band by using the prediction signal and another part without the prediction.

We shall now describe the updating of the sample buffer in more detail. In this example, the length of the sample buffer corresponds to the length of the sample sequences (quantity of samples) of three frames (FIG. 2), which is used, for example, in version 1 of the MPEG-4 audio coding system. Thus, the storage of the sample buffer contains the latest frame fr.sub.n as well as the two preceding frames fr.sub.n−1 and fr.sub.n−2. It should be mentioned that four frames are proposed to be used for the object type AAC LD in the MPEG-4 audio coding system. At the stage when a new sample sequence (one frame) is stored in the sample buffer, N samples are transferred to the left in the sequence of samples in the sample buffer, in which N corresponds to the number of samples contained in the frame. After this, the frequency-to-time converter IMDCT adds the first side of the sample sequence converted to the time domain to the latest frame fr.sub.n in the sample buffer (overlap-add), which is thus, at this stage, in the location to be used for the storage of the last frame but one, and in which the summing result is also stored. After this, this frame constitutes the last frame fr.sub.n, but one. The other side of the sample sequence converted to the time domain, which is also called the alias part, is stored as the last frame fr.sub.n in the sample buffer.

At the receiving stage, the compressed signal is decompressed. The received signal is subjected to inverse quantization of the signal. After this, such parts of the received and inverse-quantized signal, in whose compression the long-term prediction was used, are led to a coding error elimination block. Furthermore, in the long-term prediction block of the decompression block, the prediction signal is formed by using those samples stored in the sample buffer on the basis of a previously processed signal, which correspond to the samples used at the compression stage. The prediction signal is converted to the frequency level, and the coding error signal and the prediction signal are combined in the frequency domain. After the above-mentioned stages, the output of the decompression block contains a signal which substantially corresponds to the original signal but may, however, contain minor errors, due to errors possibly formed in the prediction as well as to noise caused by the quantization and inverse quantization. Such signals in which no prediction was used, are led to the frequency-to-time converter, in which the signals are converted to the time domain. Furthermore, the sample buffer is updated in the decompression block, as presented above in connection with the description of the operation of the compression block.

However, the method of updating the sample buffer according to prior art has the drawback that the transfer of samples requires a long time, because it must be performed for all frames. For this reason, the decompressing device must have a sufficient processing capacity to perform the decompression operations at a sufficiently high rate.

SUMMARY OF THE INVENTION

It is an aim of the present invention to provide a method for making the decompression of audio signals more efficient. The decompression block according to the invention utilizes, for updating the data in the sample buffer, pointers to point at the location required at a time in the buffer, wherein there is no need to transfer the sample sequences in the sample buffer. The method according to the present invention is characterized in that at least a first and a second memory pointer are used to point to the storage location of the frames, and that said memory pointers are used to point to the storage location of the frame preceding the frame processed at the time, and to the storage location of the frame preceding said past frame. The decompressing block according to the present invention is characterized in that the decompressing device comprises at least a first and a second memory pointer to point to the storage location of the frames, and means for using said memory pointers to point to the storage location of the frame preceding the frame processed at the time, and to the storage location of the frame preceding said past frame. The electronic device according to the present invention is further characterized in that the electronic device comprises at least a first and a second memory pointer to indicate the storage location of the frames, and means for using said memory pointers to point to the storage location of the frame preceding the frame processed at the time, and to the storage location of the frame preceding said past frame.

The present invention shows remarkable advantages compared to solutions of prior art. Using the method of the invention, less processing capacity is required, because there is no need to transfer sample sequences in the sample buffer. Furthermore, it is possible to utilize another possibly existing audio buffer, wherein the sample buffer can be implemented in a simpler way.

BRIEF DESCRIPTION OF THE DRAWINGS

In the following, the invention will be described in more detail with reference to the appended drawings, in which.

DETAILED DESCRIPTION OF THE PREFERRED EMBODIMENTS

Figure 1:
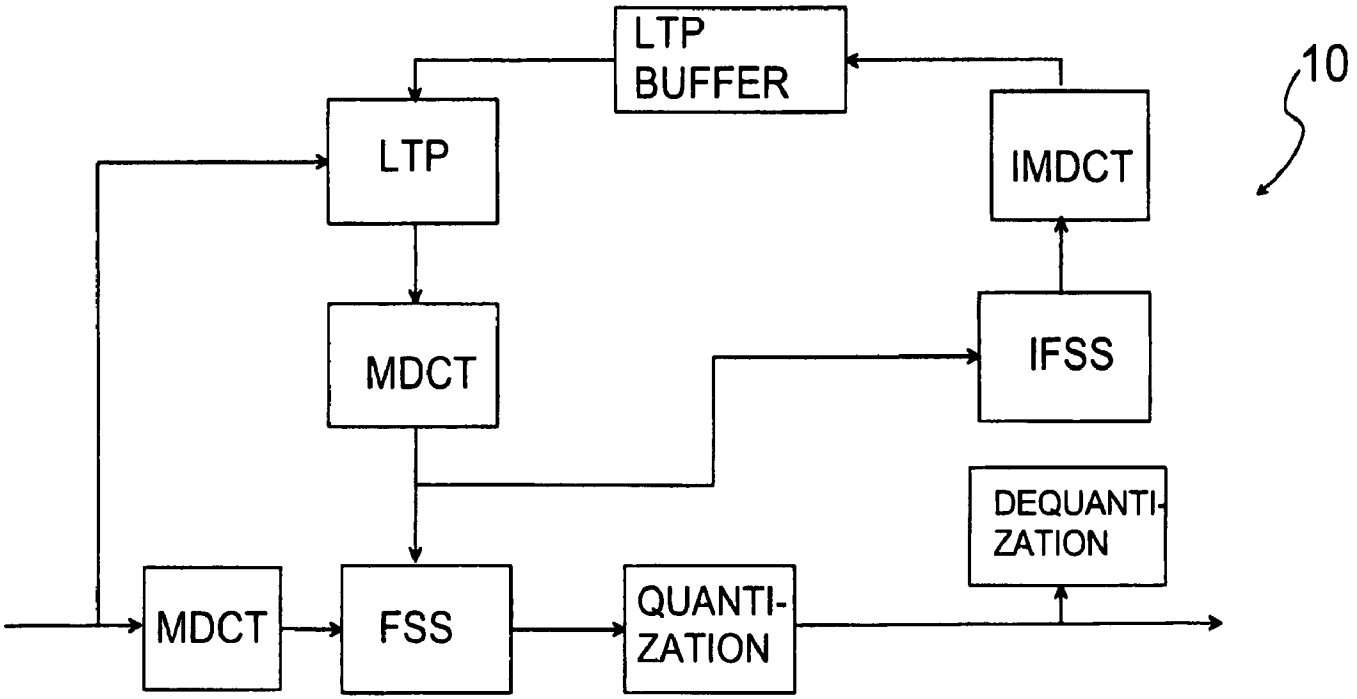
Fig. 1 (PRIOR ART)
FIG. 1 shows a long-term prediction block implemented in a decompression block according to prior art.
Figure 2:
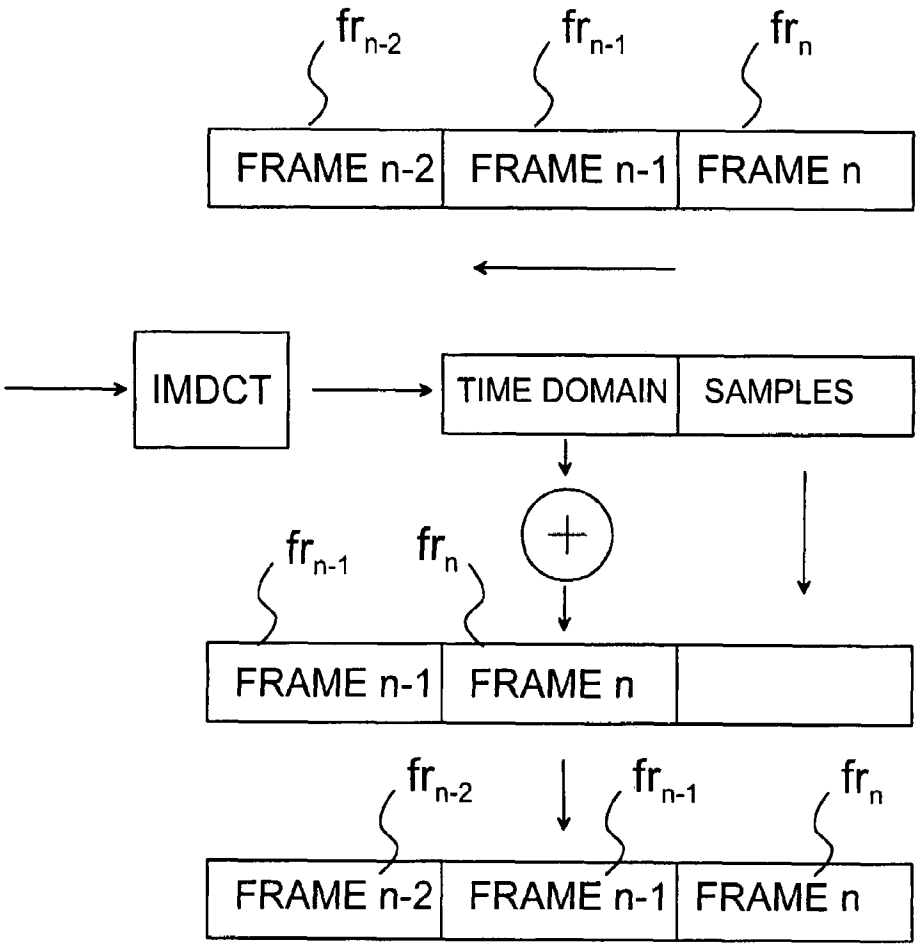
Fig. 2 (PRIOR ART)
FIG. 2 shows the steps of a prior art method for updating the sample buffer.
Figure 3:
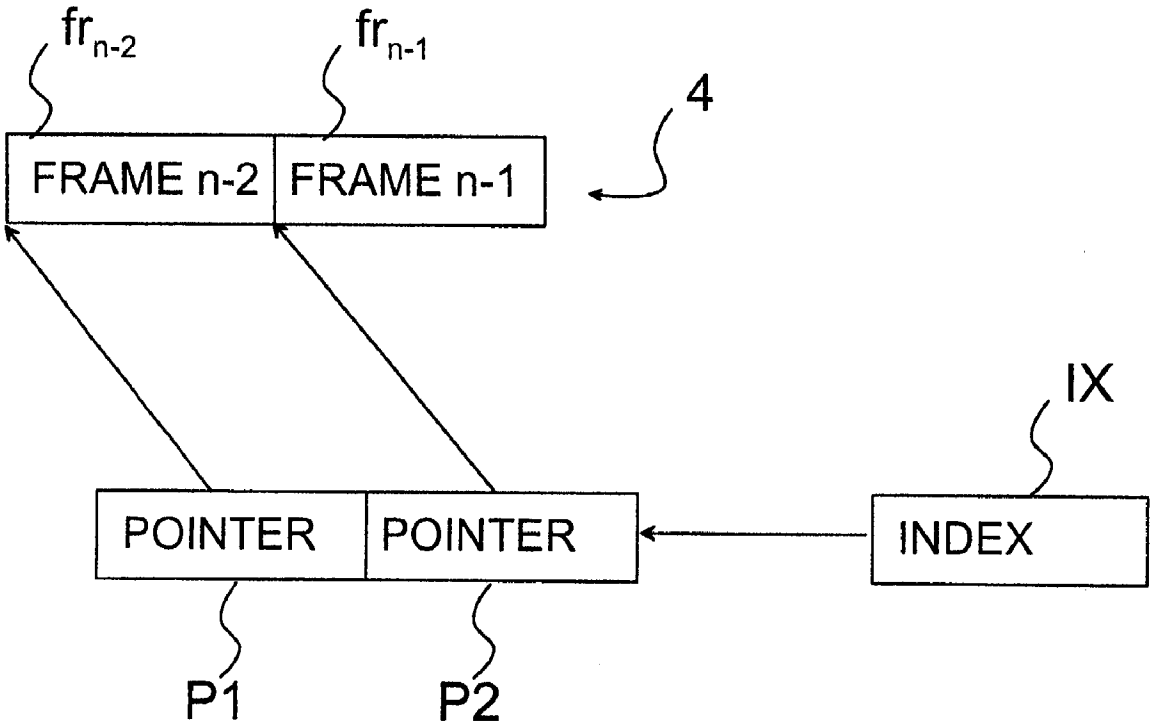
FIG. 3 shows the buffer structure to be used in the method according to a preferred embodiment of the invention in a reduced manner.
Figure 4:
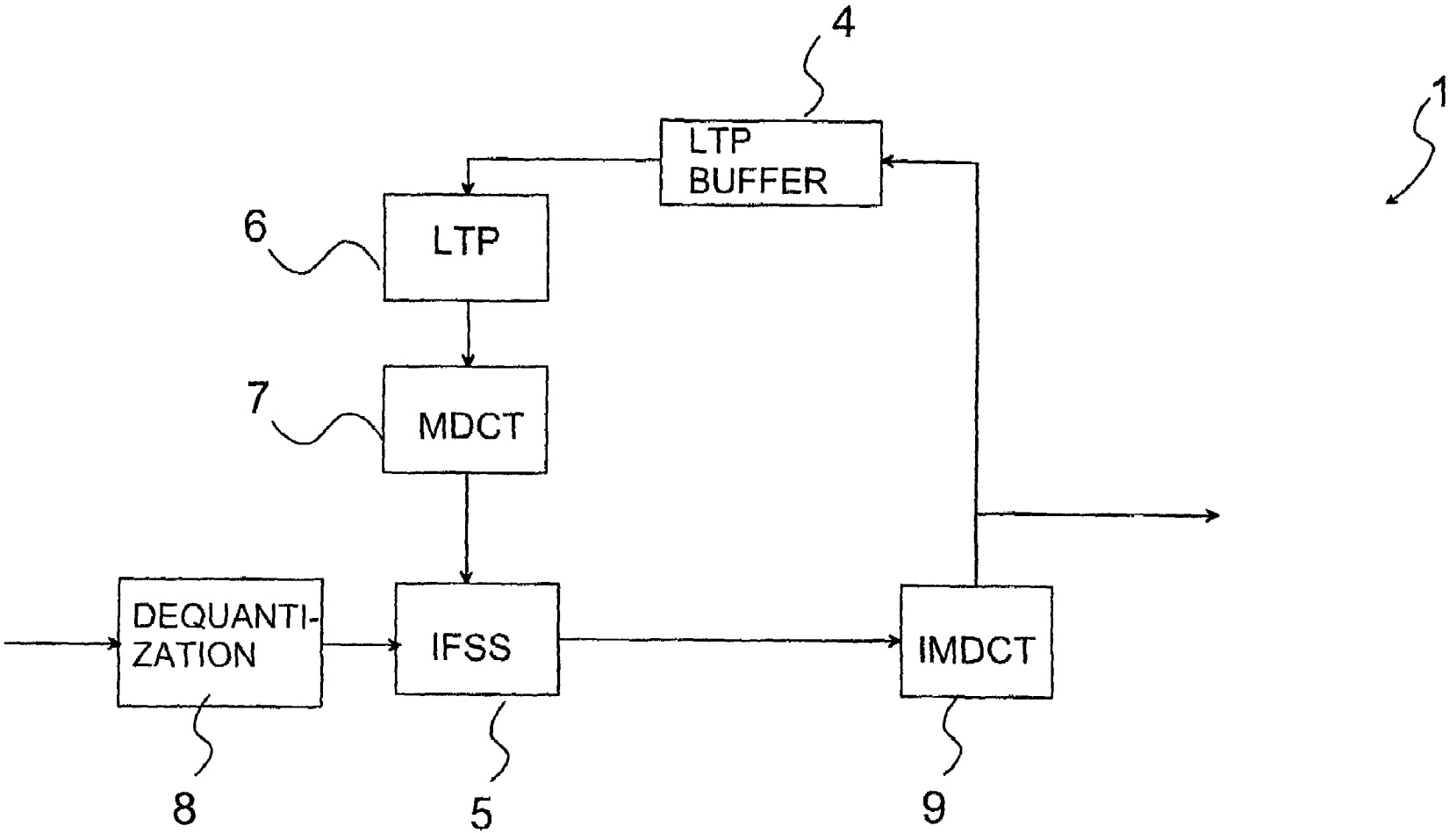
FIG. 4 shows a decompression block according to a preferred embodiment of the invention in a reduced block chart.

FIG. 4 shows, in a reduced block chart, a decompression block 1 according to an advantageous embodiment of the invention in a reduced block chart, and FIG. 3 shows the buffer structure to be used in the method according to an advantageous embodiment of the invention in a reduced manner. The decompression block 1 is, for example, a speech decoder of an electronic device 2 (FIG. 5), such as a mobile communication device, for converting a compressed audio signal back into an audio signal preferably in the following way.

In this first advantageous embodiment of the invention, a memory space is allocated for the storage of samples of frames in the memory means 3 of the electronic device 2. This memory space, which will be called the LTP buffer 4 below in this description, comprises the memory capacity required for storing the samples of, for example, four frames, and is formed, for example, as a so-called ring buffer. The decompression block 1 is also provided with memory pointers P1, P2, IX, by means of which it is possible to find the correct frame at a time in said memory space. These memory pointers can be implemented, for example, so that the first memory pointer P1 points to the beginning of the memory space allocated for the storage of samples of the frames in the LTP buffer 4, and the second memory pointer P2 points to the beginning of the memory space allocated for the storage of samples of the second frame in this memory space.

The index IX can thus be used to indicate at which point in the allocated memory space the samples of the frame needed at the time are located. This can be implemented, for example, in such a way that with the index value 0, the frame fr.sub.n−1 preceding the newest frame is stored as the second frame in the LTP buffer 4, and the frame preceding this frame (the frame preceding the preceding one) is stored at the beginning of the LTP buffer 4. Correspondingly, with the index 1, the frame fr.sub.n−1 preceding the newest frame is stored as the first frame in the LTP buffer 4, and the frame preceding this frame is stored in another memory space allocated for the samples of the frame in the LTP buffer 4. One such buffer structure is illustrated in FIG. 3. In the situation of FIG. 3, the memory pointer P1 points at the location of the samples of the frame preceding the preceding one in the LTP buffer 4 and, correspondingly, the second memory pointer P2 points at the location of the samples of the preceding frame in the LTP buffer 4. The meaning of these memory addresses P1, P2 alternates as the index value is changed.

The required number of memory pointers P1, P2 pointing to the LTP buffer 4 is preferably equal to the number of frames used in the prediction. In addition, said one index IX is required. The AAC LD object type will require three memory pointers, and the other AAC object types defined at the time of filing of the present application will require two memory pointers. The use of the memory pointers is affected, for example, by the fact whether audio buffers are available in the electronic device 2, which are used in also other steps of processing the audio signal than in decompression, as present herein. Such buffers may have been formed, for example, for the use of an application for reproducing a compressed audio signal, or another application for processing a compressed signal. Thus, if the memory pointers P1, P2 can be used to point to such audio buffers, the address values contained in the memory pointers P1, P2 are changed during the decompression of the audio signal. This requires that the decompression block 1 be informed about the memory addresses where the audio buffers are located. In practical applications, the number of audio buffers is probably greater than one, because the same audio buffer cannot be used all the time, for example, for storing the preceding frame. Thus, the audio buffers are used to alternate in such a way that each audio buffer is used in turn, for example, as a storage location for the past frame. The index IX is also used in such an application to indicate at which location each part of the frame is at a time. However, if there is only one audio buffer allocated for the application, at least one sample buffer must be additionally formed for decompression. In some embodiments, the application may transmit data about the address of the audio buffer used by the application at a time, and/or about the address of the audio buffer available for the decompression block 1, to the decompression block 10.

We shall now illustrate the operation of the memory pointers P1, P2 and the index IX in the method according to an advantageous embodiment of the invention, with an example using two frames for the prediction and at least two audio buffers for the storage of the samples of two frames. To start with, the memory pointers P1, P2 are initialized to some memory addresses, and the index IX is set to, for example, zero. The first memory pointer P1 is preferably initialized to point to the beginning of the vacant audio buffer, in which the next (first) frame is to be stored, and the second memory pointer P2 to point to the beginning of the other audio buffer. In the case of two audio buffers, the first P1 and the second P2 memory pointers do not need to be updated, but they can be set to always point to the same addresses.

Furthermore, two auxiliary memory pointers AP1, AP2 are preferably used for the prediction and for the updating of the buffers. The first auxiliary memory pointer AP1 is intended to point to the past frame fr.sub.n−1 and, correspondingly, the second auxiliary memory pointer AP2 is intended to point to the frame fr.sub.n−2 preceding the past one. At the stage when the buffer is updated, the auxiliary memory pointers AP1, AP2 and the index IX are first updated. In the following, this will be illustrated with program codes complying with the syntax of the programming language c.

1) memory_pointer_past_frame=memory_pointer_buffer [index & 0.times.1]; index++;

2) memory_pointer_frame_preceding_past_one=memory_pointer_buffer[in-dex & 0.times.1];

If the index value was first 0, it is 1 after point 1) of the first updating cycle. In connection with point 2) of the first updating cycle, the index value is not changed.

In the case of four frames, a corresponding principle can be applied, but there is one more updating, and the number used as the index mask (0.times.1) is different (0.times.3). The marking 0.times. in the numbers above indicates a 16-base number (hexa number).

After updating the auxiliary memory pointers AP1, AP2 and the index IX, the actual sample buffer can be updated, for example, by storing the samples of the newest frame in the memory space pointed by the index (memory_pointer_buffer[index & 0.times.1]). After this, the prediction operates with the same values of the auxiliary memory pointers AP1, AP2 and the index IX, until the auxiliary memory pointers AP1, AP2 and the index IX are updated again, before the next frame, preferably according to the points 1) and 2). During the second updating cycle, the values pointing to the respective points in the audio buffers are updated for the memory pointer of the past frame and for the memory pointer of the frame preceding the past one. In this way, the memory pointers can always be made to point to the correct audio buffer, wherein the samples do not need to be transferred between the different buffers to such an extent as when using solutions of prior art.

However, if there are no audio buffers available, the memory pointers P1, P2 are initialized to point to the sample buffers to be used in the decompressing device. After this, the memory pointers P1, P2 do not need to be updated, but they preferably always indicate the same point in the sample buffer. The index IX can thus be used to indicate the correct frame in the samples in the respective sample buffer, to find out the location of the past frame, the frame preceding the past one, etc. After updating the memory pointers P1, P2 and the index IX, the actual sample buffer can be updated, for example, by storing the newest frame in the memory space pointed by the index (memory_pointer_buffer[index & 0.times.1]=memory_pointer_buffer[0]). After this, the prediction operates with the same values of the memory pointers P1, P2 and the index IX, but the meaning of the memory pointers is inverse to the preceding time, until the memory pointers P1, P2 and the index IX are updated again, before the next frame, preferably according to the points 1) and 2). Consequently, during the second updating cycle, the index at point 1) has the value 1, wherein the second value of the memory pointer buffer is obtained for the memory pointer of the frame (memory_pointer_buffer[1]). After this, the index is increased by one to the value 2, wherein the first value of the memory pointer buffer is obtained for the memory pointer of the frame preceding the past one (memory_pointer_buffer[0]). When the index is increased again during the second updating cycle, the index value is an odd number.

In practice, a given number of bits is allocated for the index IX, for example one byte (=8 bits), wherein the index will turn back to zero in an overflow situation. However, this is not harmful, because said mask is used to remove extra bits from the index, i.e. only a given range of values is available. If the number of frames to be used in the prediction is a power of two, the elimination of bits with the mask can be made with an AND operation. In other cases, the mask residue (modulo) is preferably used.

If the application transmits the address of the audio buffer used in the storage of samples of the newest frame, to the decompression block 10, the decompression block sets this audio buffer address in the memory location indicated by the index (e.g. memory_pointer [index & 0.times.1]). Thus, this memory location becomes, in the next updating cycle, the memory address indicating the storage location of the preceding frame. In a corresponding manner, the memory address which indicated the past frame in the preceding updating cycle (memory_pointer_buffer[(index+1) & 0.times.1]) indicates, at this stage, the storage location of the frame preceding the past one.

It is obvious that the memory addresses can also be implemented in another way than that presented above. Also, the storage locations of the frames do not need to be consecutive. Moreover, said auxiliary buffers AP1, AP2 are not necessarily needed, but the prediction block can retrieve the values from the buffer used for the storage of the memory pointers P1, P2. In this case, the index IX is updated first after the audio buffer has been updated. Nevertheless, it is essential that the memory pointers P1, P2 and the index IX can be used to point to the correct frames during each updating cycle, wherein there is no need to copy the samples of these frames between the buffers. Only in a situation in which the audio buffers of the application cannot be used as the LTP buffer, the samples of the newest frame are copied from the LTP buffer 4 to the application. This must be performed, in a corresponding situation, also in solutions of prior art, wherein the solution according to the invention requires less copying of the samples of the frames.

In applications in which two or more channels are used, such as stereo applications, it is possible to use interleaving of the sample sequences of different channels, wherein this must be taken into account also in the operation of the prediction block and the memory addresses. The temporally equal sample sequences of the different channels are transmitted in an interleaved manner, preferably in the same frame. Thus, in the decompression block, the sample sequences of the different channels are separated from the frame. For the sake of clarity, in this description, the invention is illustrated in the case of one channel.

Such parts of the signal to be decompressed, in whose coding long-term prediction was used, are led to the coding error elimination block 5. In the inverse quantization block 8, the signal to be decompressed is subjected to inverse quantization. Furthermore, in the long-term prediction block 6 of the decompression block, the prediction signal is formed by using those samples stored on the basis of a previously processed signal, which correspond to samples used at the compression stage. Thus, in the decompression block 1, preferably the value of the first memory address P1 is retrieved by using the index IX, wherein the first memory address P1 points to the frame which is the frame preceding the past one. In a corresponding manner, the value of the second memory address P2 is retrieved by using the index IX, wherein the second memory address P2 points to the frame which is the frame preceding the frame to be decompressed.

On the basis of the memory addresses P1, P2, the required number of samples are retrieved from the sample buffer, and a long-term prediction is made in the long-term prediction block 6, utilizing received LTP coefficients to form the prediction signal. This prediction signal is converted to the frequency domain in the time-to-frequency converter 7. After this, in the coding error elimination block 5, the coding error signal and the prediction signal are combined in the frequency domain. The signal is then converted to the time domain in the frequency-to-time converter 9. If necessary, the samples of the reconstructed signal are truncated to a given length. The first side of this sample sequence is summed with the alias part stored in connection with the past frame, and the summing result is stored in the samples of the frame in the memory location indicated by the second memory pointer P2. The alias part of the newest sample sequence is stored in a memory location allocated for it, which does not necessarily need to be in connection with the sample buffer.

Also the memory pointers must be updated, for example, by increasing the value of the index IX by one. At this point, it is examined if the value of the index IX is within the allowed limits, i.e. it points to a frame in the sample buffer. If the value of the index IX is no longer within the allowed limits, the value of the index IX is set to a certain initial value, such as 0, wherein it points to the beginning of the sample buffer. After updating the index, the first memory address P1 points to the memory space preceding the frame just decompressed, which, consequently, is frame fr.sub.n−2 when the next frame is decompressed. Correspondingly, the second memory address P2 points to the frame just decompressed, which, consequently, is frame fr.sub.n−1 when the next frame is decompressed.

In some applications, a given number of previously decompressed frames are stored in the electronic device which decompresses the compressed audio signal, for example, to secure uninterrupted reproduction of the audio signal. In this case, these stored frames can also be utilized in the operation of the prediction block, wherein a separate LTP buffer will not be needed at all. In such an application, the first P1 and the second P2 memory pointers are set to point to the frames stored in the respective memory space.

In any case, the decompression block 1 stores the alias part of the latest sample, wherein a separate memory space will not be needed for the storage of the alias part in the LTP buffer either, but a memory pointer can be arranged which points to the respective memory and by means of which the above-presented operations can be performed in the prediction block.

It is obvious that the present example only discloses the features which are most essential for applying the invention, but in practical applications, the electronic device 2 and the decompression block 1 also comprise other functions than those presented herein. In connection with the compression and decompression according to the invention, it is also possible to use other coding methods, such as short-term prediction, Huffman coding/decoding, etc.

The correlation between the prediction signal and the real signal can also be determined for signals in the time domain. In this case, the signals do not need to be converted to the frequency domain, wherein the conversion blocks 7, 9 are not necessarily needed. The coding error is thus determined on the basis of the signals in the time domain.

The above-presented audio signal compression/decompression steps can be applied in various communication systems, such as mobile communication systems, satellite TV systems, video on demand systems, etc. For example, a mobile communication system in which audio signals are transmitted in a full duplex manner, requires a compression/decompression block pair (codec) both in the mobile communication device 2 and in the base station or the like.

The above-presented compression steps are not necessarily taken in connection with the transmission, but the compressed information can be stored to be transmitted later on. Furthermore, the audio signal to be led to the decompression block 1 does not necessarily need to be a real-time audio signal, but the audio signal to be decompressed can be previously stored, compressed information on the audio signal.

The steps of the method according to the invention can be, to a great extent, implemented, for example, as program codes in the control means 11 of the electronic device 2, e.g. in a microprocessor or the like, which is known as such for anyone skilled in the art.

Figure 5:
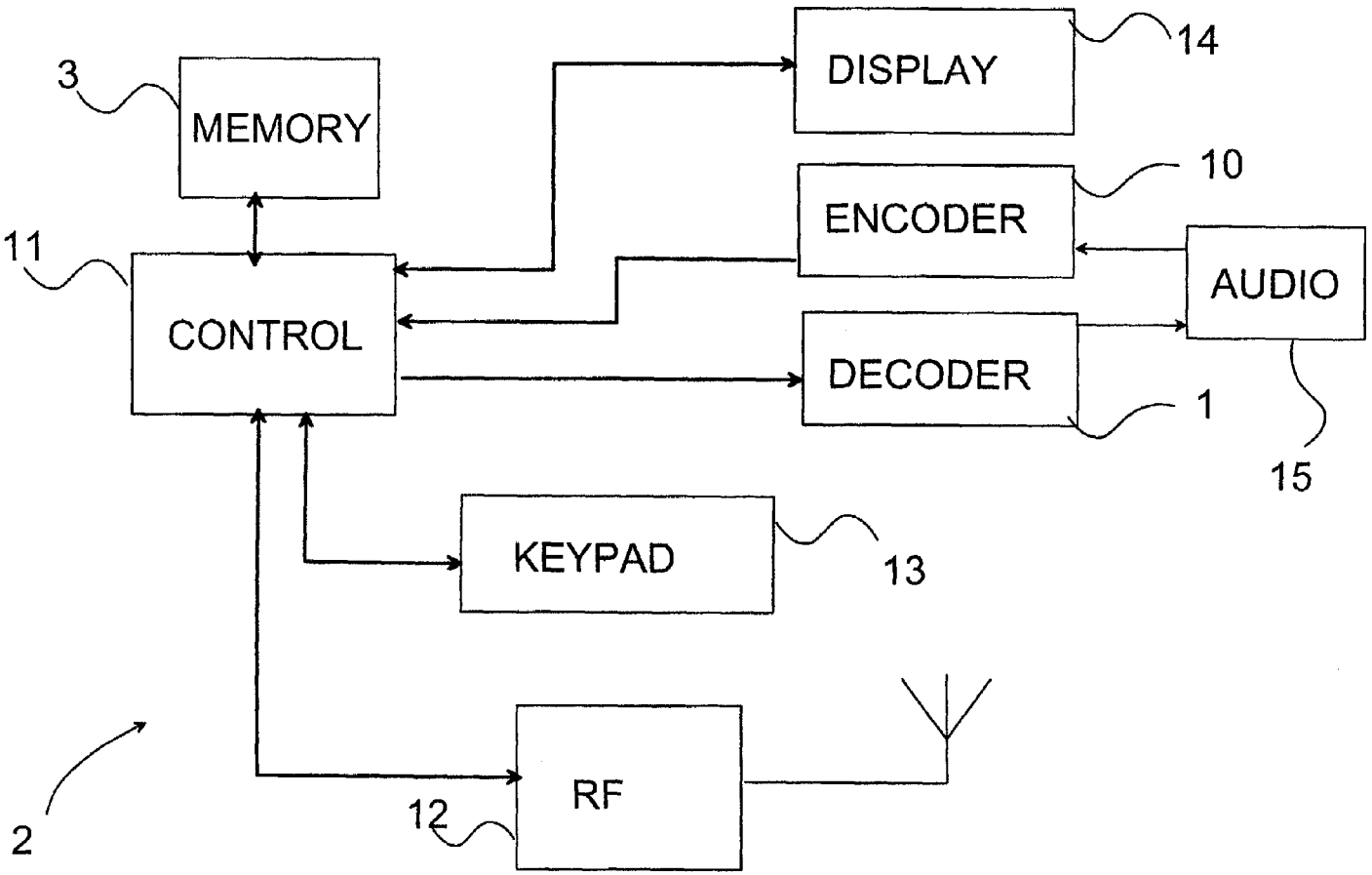
FIG. 5 shows an electronic device according to a preferred embodiment of the invention in a reduced block chart.

The electronic device 2 shown in FIG. 5 further comprises e.g. a radio part 12, a keypad or keyboard 13, a display 14, and audio means 15.

Also in other respects, the present invention is not limited solely to the above-presented embodiments, but it can be modified within the scope of the appended claims.

What is claimed is:

1. A method in the decompression of a compressed audio signal, in which compression a predicting coding has been used, wherein samples taken from the audio signal have been formed into frames, and samples of the frames have been compared with samples of at least one previous frame to find out the prediction error, in which method frames of the compressed audio signal are stored, and predicting decoding is used to decompress the audio signal compressed with the coding on the basis of said stored frames, wherein at least a first and a second memory pointer are used to point to the storage location of the frames, and that said memory pointers are used to point to the storage location of a previous frame preceding the frame processed at the time, and to the storage location of the frame preceding said previous frame.

2. The method according to claim 1, wherein also an index is used to indicate which of said memory pointers points to the storage location of the previous frame at the time, and which of said memory pointers points to the storage location of the frame preceding said previous frame.

3. The method according to claim 2, wherein the samples of at least two frames are stored during the decompression.

4. The method according to claim 3, wherein a memory space is determined for storing at least two frames during the decompression, said first memory pointer is used to point to the beginning of said memory space, the second memory pointer is used to point to the beginning of the memory space allocated for the storage of the second frame in said memory space, and that the index is used to indicate the location of the latest frame stored each time in said memory space.

5. The method according to claim 1, wherein the frame to be processed is divided into two parts, wherein the first part is stored as an alias part, and the second part is summed with the alias part stored in connection with the processing of the frame preceding the frame to be processed, and the summing result is stored in the location indicated by the memory pointer pointing to the storage location of the previous frame.

6. The method according to claim 5, wherein the audio application is used to reproduce the audio signal being decompressed as an audio signal, the audio application is provided with at least one audio buffer for storing samples of the frame, and that said at least one audio buffer is used in the decompression of the compressed audio signal, wherein at least one memory pointer is used to point to said at least one audio buffer.

7. The method according to claim 1, wherein said prediction error, determined in the compression of the audio signal, is used in the predicting decoding during the decompression, to eliminate prediction errors.

8. The method according to claim 7, wherein the prediction error is determined on the basis of the audio signal converted to the frequency domain.

9. A decompressing device for decompressing a compressed audio signal, in which compression a predicting coding has been used, wherein samples taken from the audio signal have been formed into frames, and samples of the frames have been compared with samples of at least one previous frame to find out the prediction error, which decompressing device comprises memory means for forming at least one buffer for storing frames of the compressed audio signal, and means for performing the predicting decoding in the decompression of the audio signal compressed with the coding on the basis of said stored frames, wherein the decompressing device comprises at least a first and a second memory pointer to point to the storage location of the frames, and means for using said memory pointers to point to the storage location of the frame preceding the frame processed at the time, and to the storage location of the frame preceding said previous frame.

10. The decompressing device according to claim 9, wherein said means for using said memory pointers comprise an index which is arranged to indicate which of said memory pointers at a time is set to point to the storage location of the previous frame and which of said memory pointers is set to point to the storage location of the frame preceding the previous frame.

11. The decompressing device according to claim 10, wherein the memory means comprise at least two buffers to store the samples of at least two frames upon the decompression.

12. The decompressing device according to claim 11, wherein said first memory pointer is set to point to the beginning of said memory space, said second memory pointer is set to point to the beginning of the memory space allocated for the storage of the second frame in said memory space, and that the index is arranged to be used to indicate the location of the latest stored frame each time in said memory space.

13. The decompressing device according to claim 9, wherein it comprises means for dividing the frame to be processed into two parts, wherein the first part is stored as an alias part, means for summing the second part with the alias part stored in connection with the processing of the frame preceding the frame to be processed, and means for storing the summing result in the location indicated by the memory pointer pointing to the storage location of the previous frame.

14. The decompressing device according to claim 9, wherein it comprises means for using the prediction error determined during the compression of the audio signal, in the predicting decoding upon the decompression, to eliminate prediction errors.

15. An electronic device comprising a decompressing device for decompressing a compressed audio signal, in which compression a predicting coding has been used, wherein samples taken from the audio signal have been formed into frames, and samples of the frames have been compared with samples of at least one previous frame to find out the prediction error, which electronic device comprises memory means for forming at least one buffer for storing frames of the compressed audio signal, and means for performing the predicting decoding in the decompression of the audio signal compressed with the coding on the basis of said stored frames, wherein the electronic device comprises at least a first and a second memory pointer to indicate the storage location of the frames, and means for using said memory pointers to point to the storage location of the frame preceding the frame processed at the time, and to the storage location of the frame preceding said previous frame.

16. The electronic device according to claim 15, wherein it comprises means for performing an audio application, the audio application being arranged to reproduce the audio signal to be decompressed, that the audio application is provided with at least one audio buffer for storing samples of the frame, and that the electronic device comprises means for using said at least one audio buffer in the decompression of the compressed audio signal, and means for pointing to said at least one audio buffer with at least one memory pointer.

17. A decompressing device for decompressing a compressed audio signal, in which compression a predicting coding has been used, wherein samples taken from the audio signal have been formed into frames, and samples of the frames have been compared with samples of at least one previous frame to find out the prediction error, which decompressing device comprises:

memory for forming at least one buffer for storing frames of the compressed audio signal;

a predictor for performing the predicting decoding in the decompression of the audio signal compressed with the coding on the basis of said stored frames;

at least a first and a second memory pointer to point to the storage location of the frames; and a memory pointing element for using said memory pointers to point to the storage location of the frame preceding the frame processed at the time, and to the storage location of the frame preceding said previous frame.

18. An electronic device comprising a decompressing device for decompressing a compressed audio signal, in which compression a predicting coding has been used, wherein samples taken from the audio signal have been formed into frames, and samples of the frames have been compared with samples of at least one previous frame to determine the prediction error, which electronic device comprises:

memory for forming at least one buffer for storing frames of the compressed audio signal;

a predictor for performing the predicting decoding in the decompression of the audio signal compressed with the coding on the basis of said stored frames;

at least a first and a second memory pointer to indicate the storage location of the frames; and a memory pointing element for using said memory pointers to point to the storage location of the frame preceding the frame processed at the time, and to the storage location of the frame preceding said previous frame.

* * * * *